United States Patent [19]

Brescia et al.

[11] 4,437,414

[45] Mar. 20, 1984

[54] FOLDING TABLE FOR WALL MOUNTING

[75] Inventors: Tony Brescia, Liverpool; Ross Deacon, Syracuse, both of N.Y.

[73] Assignee: Syroco, Inc., Syracuse, N.Y.

[21] Appl. No.: 305,137

[22] Filed: Sep. 24, 1981

[51] Int. Cl.[3] ..... A47B 5/04

[52] U.S. Cl. ..... 108/134; 108/81; 248/240

[58] Field of Search ..... 108/134, 135, 80, 81; 248/240, 240.4; 211/150, 149

[56] References Cited

U.S. PATENT DOCUMENTS

| | | | |
|---|---|---|---|
| 102,528 | 5/1870 | Forrest | 108/81 |
| 336,757 | 2/1886 | Seng | 108/81 |
| 934,985 | 9/1909 | Girard | 108/134 |
| 4,068,601 | 1/1978 | Marsh et al. | 108/134 |

FOREIGN PATENT DOCUMENTS

| | | | |
|---|---|---|---|
| 535083 | 12/1956 | Canada | 248/240 |
| 377672 | 7/1932 | United Kingdom | 108/134 |

*Primary Examiner*—William E. Lyddane

*Attorney, Agent, or Firm*—Stanley R. Moore

[57] ABSTRACT

A folding work surface having self-locking, pivotal support arms for selective support and storage upon a vertical wall. A triangular pivot configuration comprising each support arm permits the work surface to be secured upon a wall with a minimum of effort and a maximum of structural reliablilty. A pair of stationary wall brackets pivotally connect the work surface and support arms one to the other and to the wall. Each pivot arm includes an elongated primary support strut pivotally connected to the wall bracket, and a shorter locking arm pivotally coupled to the support strut. The locking arm pivots inwardly to laterally engage the work surface, resting thereagainst in the open, supported position. In the collapsed position, the triangular pivot configuration permits the support arms to fold against the work surface to facilitate storage.

10 Claims, 5 Drawing Figures

FOLDING TABLE FOR WALL MOUNTING

BACKGROUND OF THE INVENTION

The present invention relates to a folding work surface, and, more particularly, to a wall mounted folding table having pivotal supports members adapted to pivot about the wall and within themselves to afford structural support in an open table position, and folded containment in a closed, collapsed position.

Folding tables have for years been employed in homes, offices, public areas and even within motor vehicles to accommodate the intermittent needs of the occupants for both free space and a convenient work surface. The design and installation parameters for such work areas generally include limited space and the need for compactness during periods of non-use. For this reason, wall mounted folding tables have been designed and produced in many shapes, forms and hinged configurations.

Major considerations in the design of collapsible work surfaces have, in the main, been their ease of use and stability. Prior art solutions to these concerns have been varied. The most common approach has been a pair of pivotally interconnected support legs of equal length, which when folded, are axially aligned at 0° relative to each other through an inter-connecting pivot point. In the open position, the support arms are rotated about their pivot point so that they are in axial alignment and comprise a straight strut. The support arms are generally secured in the open position by suitable locking mechanisms mounted at the intermediate point of pivot. Often a pair of laterally opposed support members are used to support the strut and work surface. The work surface itself is conventionally hinged to a wall mountable bracket or directly to the wall.

By definition, a folding table must readily collapse. This design function generally necessitates the disengagement of some strut locking mechanism and the prior art approach to such strut support aspects have been many. The "pin-slot" configurations is one example. A support and locking pin is mounted on one support arm segment for engagement with a slot or cutaway when the surface is raised. Cleats may also be used and are generally of the "self-actuation support" type which are disengaged by the raising of the table. It may be noted that such mechanisms are also commonly found in hinged articles other than work tables.

Other prior art strut locking and latch support approaches include slip latches, detent latches, slotted brackets and related fastening mechanisms. Such devices are shown and described in the following U.S. Patents.

| U.S. Pat. No. | Date |
|---|---|
| 1,224,129 | May 1, 1917 |
| 2,483,899 | October 4, 1949 |
| 2,843,436 | July 15, 1958 |
| 2,943,896 | July 15, 1960 |
| 3,113,533 | December 10, 1963 |
| 2,031,287 | February 18, 1936 |
| 3,249,073 | May 3,1966 |

From the above patents it may be seen that collapsible work surfaces utilizing pivotally connected support arms are well known in the prior art. Although such solutions have been found to be acceptable, certain problems have been found to be associated with structural mechanisms in general. Many structural latch devices are cumbersome to use, complicated to release, and due to the inherent design, subject to loading failure in the latch. More specifically, the problem is the "weak-link" characteristic of the assemblage. Often the open strut latch is not designed for supporting significant amounts of pressure. Once the latch breaks, the work surface is allowed to collapse. In this sense, the supporting latch is the weak link in the support network.

It would be an advantage to provide a collapsible work surface which would combine ease of use and simplicity of release with a strut support which is functionally rigid and does not manifest a structural dependence upon any latching device. The present invention provides such a structure wherein the support arm is constructed so that in the open position, the weight of the table is borne directly by a rigid support arm portion. The support arm assemblage thus does not require a separate structural latch and is engaged and disengaged simply by the raising of the work surface. In this manner a more structurally sound folding work station can be provided incorporating simplicity of design and reliable operation.

SUMMARY OF THE INVENTION

The invention relates to a wall mounted, foldable table which is selectively supported by at least one pivotal support arm for use and storage. More particularly, a triangular pivot configuration comprises each support arm and permits the arm to be bent as an elbow along the interface of loading for locking the support surface in an open configuration. Similarly, the arm is bent in a downward direction for unlocking the support and allowing the work surface to fold against the supporting wall. A wall mountable, supporting bracket is provided and pivotally attached to one end of the support arm. Each support arm further comprises opposing long and short sections pivotally connected one to the other within said triangular configuration. The short section is pivotally connected to the work surface, while the long section is pivotally attached to the wall bracket.

In another aspect the invention includes a planer, wall mountable work surface pivotally constructed for securement adjacent a support wall in the closed configuration, and in a generally orthogonal, open configuration relative to the support wall for utilization thereof. The work surface is supported by a pair of foldable support arms. Each support arm is constructed with an elongate wall support member pivotally connected to a relatively shorter table connecting member. Each support arm further includes a triangular pivot configuration whereby pivoting occurs between the shorter table connecting arm and the work surface, between the shorter and longer arm, and between the longer arm and a wall mounting bracket. In this manner the work surface can be opened and supported directly through a rigid support element. The table may likewise be collapsed by permitting the pivotal support arms to flex downwardly under the pull of gravity to allow the work surface to pivot relative to the wall and conventionally thereagainst.

In yet another aspect, the invention includes a method of providing a horizontal work surface relative to a vertical wall comprising the steps of pivotally connecting a planer work surface to an upright wall, and providing a foldable support arm relative thereto. The support arm is provided with a triangular pivot configuration for permitting bi-directional flexure relative to the wall and the support surface. The work surface is pivoted outwardly to an open, orthogonal position relative to the wall while the support arm is pivoted upwardly, permitting a first arm segment to horizontally engage the orthogonal table surface while the second arm segment depends downwardly therefrom in an angular engagement with the wall surface. The work surface is collapsed against the wall by the lifting of the work table and permitting the support arm to flex in a downward direction while the work surface is folded against the wall to contain the flexed support members therewithin.

In yet another aspect, the invention includes a triangularly pivoted support arm adapted for selective support and engagement of a planer work surface. The support arm comprises a pair of segmented support sections, one substantially longer than the other and pivotally hinged therebetween. The opposite ends of each section are similarly pivotally connected to one portion of the work surface and oppositely therefrom to the supporting wall. The triangular support formed by the segmented support arm affords direct support of the work table. The longer support segment comprises the load bearing arm portion which carries the weight of the support surface and any force thereupon back to the support wall.

In yet another aspect of the invention, the structure includes a safety latching mechanism for engaging the support arms in the open configuration, latching the pivot of the support arms to prevent collapse from inadvertent actuation. The latching means includes a slot formed in the end of a shorter, segmented support arm adapted for receiving a fastening member therein when the table is in an open, orthogonal configuration relative to a vertical wall. The latch then locks the position of the table without bearing any load therethrough.

BRIEF DESCRIPTION OF THE DRAWINGS

For a more complete understanding of the present invention and for further objects and advantages thereof, reference may now be had to the following description taken in conjunction with the accompanying drawings, in which.

DETAILED DESCRIPTION

Figure 1:
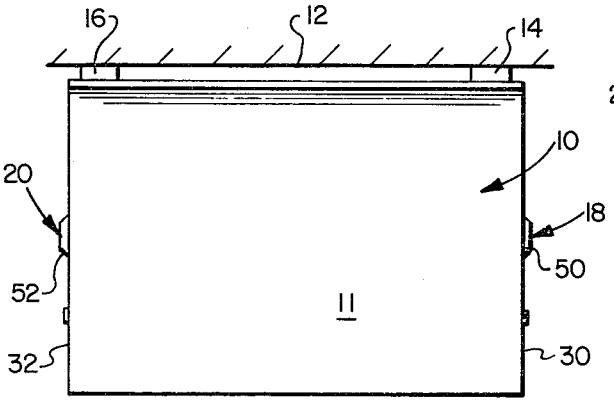
FIG. 1 is a top plan view of one embodiment of a wall-mountable, foldable table structure constructed in accordance with principles of the present invention.

Referring first to FIG. 1, there is shown a top plan view of a wall-mountable folding table structure 10 pivotally secured to a wall 12 in a generally horizontal supporting position. The table 10 includes a planar work surface 11 mounted to the wall 12 by support-pivot brackets 14 and 16. The table surface 11 is secured in the open position shown by a pair of underlying support arms 18 and 20 which provide both reliable support and collapsibility through a triangular pivot configuration.

Figure 2:
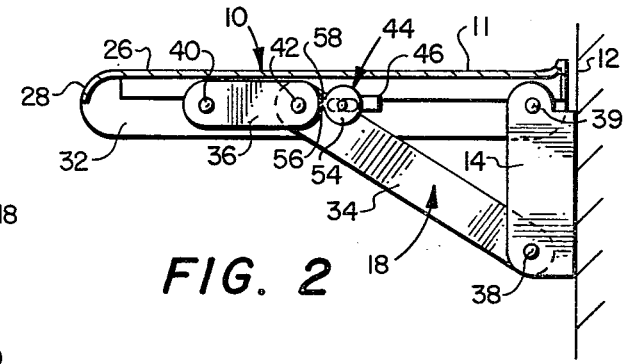
FIG. 2 is a side elevational, fragmentary view of the foldable table of FIG. 1 illustrating the support mechanism thereof in the raised position relative to a supporting wall.

Referring now to FIG. 2 there is shown a side elevational, fragmentary view of the foldable table 10 of FIG. 1 in the open, or supported configuration. The table surface 11 may be seen to be pivotally connected to and supported by the wall 12 through the wall brackets 14 and 16 secured to the wall and bracing the table surface 11 through angulated positioning of the arms 18 and 20. The table surface 11 is comprised of a planer upper surface 26, rounded nose portion 28, and a pair of side frame members 30 and 32. Side 30 has been cut away for purposes of clarity to reveal side frame 32 in the opposite side. The side frames 30 and 32 are coupled to the support arms 18 and 20, respectively.

Still referring to FIG. 2, there is shown the support arm 18 in braced engagement of the table surface 11. The support arm 18 is comprised of a lower elongate, support member 34 and an upper, shorter table member 36. Support member 34 is pivotally connected to the wall bracket 14 through pivot connection 38. Likewise wall bracket 16 is pivotally connected to pivot arm 20 through an opposite pivot connection (not shown). The table support arm 36 is pivotally connected to the side frame 30 (not shown in FIG. 2) of the table 11 through a pivot 40 extending therethrough. The upper arm 36 is pivotally connected to the lower arm 34 through pivot point 42. This pivot attachment is shown in more detail in FIG. 5 to be discussed below.

The utilization of the foldable table 10 is afforded through select angulation of the pivotal support arms 18 and 20. Each arm is constructed in a triangular pivot configuration, which permits the table 11 to be directly supported by a unitary strut without structural loading through an intermediate fastening mechanism. This configuration also affords the foldability necessary for the complete collapse of the table. When the table 10 is in an open position, the table surface 26 is oriented in a generally orthogonal direction relative to the wall 12. The short arm segment 36 acts as a rigid spacer separating the pivot point 42 from the pivot point 40. In this manner, a downward force upon the table surface 26 causes the opposite ends of arm 18 to bear against the wall 12, said table surface and the locked, upper arm 36 at the same time. The table 24 is thereby effectively supported without the necessity of a separate, structural latching means.

Referring still to FIG. 2, there is shown an optional, non-structural, latching mechanism 44 which is utilized as a safety latch for the support arms 18 and 20. The latch prevents inadvertent collapse of the table 10 by locking the support arms 18 and 20 in the open position. The latch serves no structural function in that its absence of engagement does not effect the functioning or strength of the table 10. The latch 44 is comprised of a slot 46 formed in the side walls 30 and 32 of the table 11. A pair of outwardly disposed slide members 50 and 52 are affixed outwardly of the side frames 30 and 32, respectively for movement of a latching element 54 on the inside of said side frames. Latching element 54 includes a finger portion 56 which matingly engages a slot 58 formed in each of the table support segments 36. Slot 58 may be seen more clearly in FIGS. 3 and 5. When the latch 44 is in engagement with the support segment 36, pivotting of the arms 18 and 20 through lifting of the table 11 is prevented. In this manner, the supporting configuration of the arms 18 and 20 cannot be inadvertently altered in a manner causing a collapse of the table 10.

Figure 3:
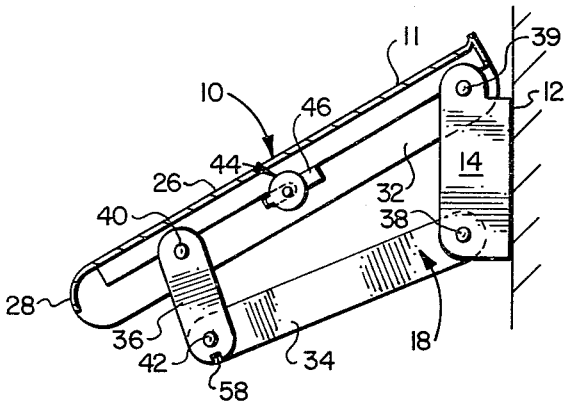
FIG. 3 is a side elevational view of the foldable table of FIG. 2 in the collapsing position, illustrating the folding configuration of the support arms.

Referring now to FIG. 3 there is shown the work table 10 of FIG. 2 in an intermediate or folding configuration. The table 11 is still shown in a fragmentary cutaway view wherein the side wall 30 of said table has been removed for purposes of clarity. In this folding orientation it may be seen that the pivot arms 18 and 20 are shown flexing downwardly whereby pivot 42 permits downard rotation of the upper and lower arms 36 and 34. The rotation of the upper segment arm 36 away from the table 11 causes said table to assume the downwardly oriented position shown. In this folding configuration the table 11 is also rotated about the table pivot 39 of wall brackets 14 and 16 while the lower support segments 34 also rotate about point 38 of the respective wall brackets. The support arm segments 36 and 34 thus rotate about the intermediate pivot point 42 while the upper support arm segment 36 rotates about its pivot point 40 of the table 11. The triangular pivot configuration can thus be seen to afford maximum flexibility with a minimum of complexity. It should be noted also that the latch 44 is shown in the open position, wherein it has been slid backwards away from the slot 58 of the pivot arm segment 36 to allow the aforesaid folding.

Figure 4:
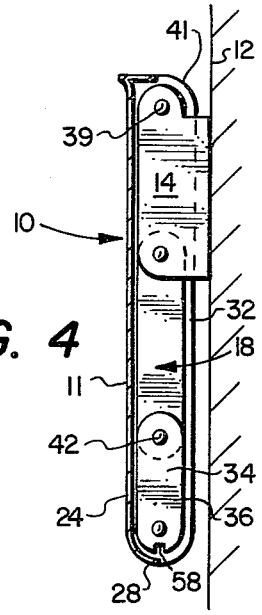
FIG. 4 is a side elevational view of the folding table of FIG. 2 in the collapsed position relative to a supporting wall.

Referring now to FIG. 4, there is shown the folding table 10 of the present invention collapsed against the wall 12. The wall bracket 22 suspends the table 11 as the collapsed support arms 18 and 20 are contained within. In this folded position, it may be seen that the length of the work table 11 is sufficiently great to receive the outwardly rotated, upper table support segment 36 therein. The contour of the end of the respective support segment 36 and nose 28 of the table 11 are complimentally formed to allow maximum utilization of the respective spaces. It may be seen that the support arm 18 in this folded configuration permits a side-by-side, parallel relationship between upper table segment 36 and lower support segment 34. Such a folded side-by-side relationship maximizes the folding space within the table structure 24. It may further be seen that a rear portion 41 of the table 11 is similarly formed with a curved, arcuate edge portion to facilitate rotation of the table 24 about the pivot 39 of brackets 15 and 16, without interference with the wall 12.

Figure 5:
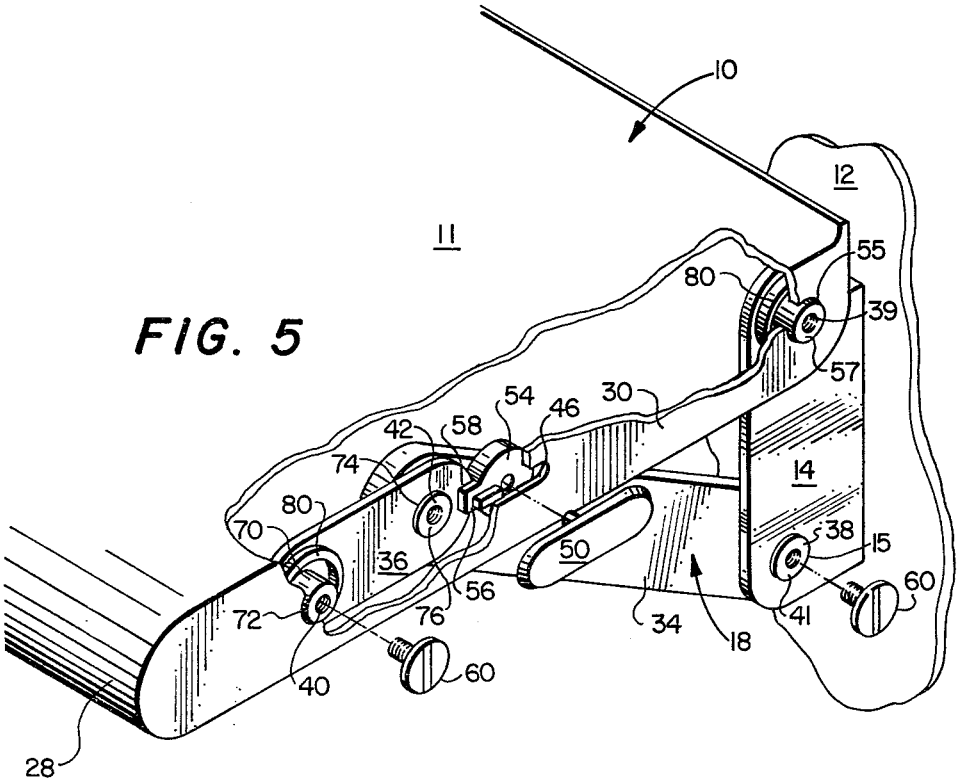
FIG. 5 is an enlarged, perspective, fragmentary view of the foldable table of FIG. 1 illustrating the operation and assembly thereof.

Referring now to FIG. 5 there is shown an enlarged perspective, cutaway view of the work table 10 of the present invention in the open position. The table 11 is shown positioned upon a wall section 12. The operation and assembly of the work table 10 can best be described by attention to the underlying support assembly. The pivot 38 or attachment bracket 14 is herein shown to include a lower pivot aperture 15 and pivot shaft 41. A threaded fastening member 60 secures the pivot assembly. The pivot shaft 41 permits the support arm 18 to rotate within the aperture 15. Likewise, a similar pivot assembly is provided in upper pivot 39 comprised of aperture 55 and shaft 57. The table arm segment 36 also includes a pivot shaft 70 which extends through aperture 72 formed in the side wall 30. Pivot arm 36 includes aperture 74 on the opposite end for receiving pivot shaft 76 of the lower support arm 34. In this manner, a minimum number of assembly elements are necessary for the assembly and operation of the support table 10. It should be noted that the table and its elements may be advantegeously molded of lightweight material such as plastic with spacers, washers and the like integrally molded in and around the pivots. For example, circular pivot washers, or spacers, 80 may be seen to be provided formed around the respective pivot shafts.

In operation, the support table 10 is secured to an upright wall 12 through the support brackets 14 and 16. Suitable fastening members such as wall screws or toggle bolts may be utilized to secure the brackets 14 and 16 to the wall 12. The table 24 is constructed to afford ample clearance between the wall and the rear portion 41 as shown in FIG. 4. The table 11 is then pivotally connected to the brackets 14 and 16 through pivots 39 by the use of suitable fasteners 60. In the present embodiment threaded fasteners in the form of screws are used. In the open position, the table 11 is raised over the upper arm segment 36 which is manually rotated upwardly and received thereunder and caused to rest against the underneath table surface and support leg 34. Latch members 44 are actuated through latch handles 50 and 52 which cause finger portion 56 to be slidably received within the slots 56. With the latches 44 engaged, the table 10 is prevented from further pivoting about pivot 39 through the locking of the pivot arms 18 and 20. The table 10 is lowered through a reversal of these steps, wherein the pull of gravity will cause the upper segment 36 to rotate downwardly once the table 11 has been inclined into the upward position.

It is thus believed that the operation and construction of description. While the wall-mountable, folding table and method of assembly thereof shown and described has been characterized as being preferred, it will be obvious that various changes and modifications may be made therein without departing from the spirit and scope of the invention as defined in the following claims.

What is claimed is:

1. A wall mountable folding table adapted for positioning substantially flush against a vertical wall in a first position and generally orthogonal thereto in a second, rotated position, said table comprising:

a generally planar table surface having top and bottom surfaces and side frame members on opposite sides thereof defining a space therebetween and under said table surface;

at least one wall mountable support bracket adapted to be secured against a generally vertical wall and pivotally connected to said table for the support thereof and being constructed of a size affording its receipt substantially within the area of the side frame members in said space therebetween;

first and second support arms pivotally connected to said side frame members at one end and to said support bracket at an opposite end, each of said support arms having an intermediate pivot connecting upper and lower portions of said support arm for permitting relative rotation therebetween and relative to said table surface and said support bracket;

said upper portion of said support arm being received against said botom table surface when said top table surface is oriented generally orthogonal to said support bracket in said second position;

said side frame members of said folding table including latching means for locking said arms in a supporting position relative to said table surface when said table surface is oriented generally orthogonal to said support bracket in said second position;

said latching means including a slot formed in at least one of said side frame members and a sliding member mounted therein for rectilinear movement relative to said adjacent support arms for the engagement thereof;

at least one of said adjacent support arms including a slot formed therein for receiving said slide member of said latching means mounted upon said side frame member for the locking of said support arm by the rectilinear movement of said latching means and wherein said latching means is positioned adjacent said intermediate pivot of said adjacent support arm when said upper support arm is received against said bottom table surface;

said lower portion of said support arm depending from said intermediate pivot in direct structural relationship between said bottom table surface and said support bracket when said top table surface is oriented generally orthogonal to said support bracket in said second position; and said support arms being constructed of a width substantially no greater than the width of said table side frame members for the foldable receipt of said support arms adjacent said side frame members in said space therebetween when said table is pivoted into said first position against said vertical wall.

2. The apparatus as set forth in claim 1 wherein said upper portion of said support arm is substantially shorter than said lower portion and is pivotally mounted to said side frame member for being received against said bottom table surface and contained substantially within said side frame members when said table surface is in a folded position against a supporting wall.

3. The apparatus as set forth in claim 1 wherein said support arms include integrally molded pivot shafts and pivot shaft apertures received therearound for permitting said relative rotation between said upper and lower support arm portions, said table surface, and said wall brackets.

4. The apparatus as set forth in claim 1 wherein each of said support arms include said latching means for locking said arms relative to said table surface with said table in the outward position.

5. An improved, wall mountable, folding table of the type wherein a substantially planar surface having side frame members on opposite sides thereof is hingedly connected to a vertical wall and supported therefrom by support arms of the type facilitating an open position of the table in a generally orthogonal relationship to the vertical wall, and a selective, second, folding position of the table against said supporting wall wherein the improvement comprises first and second support arms being constructed of a triangular pivot configuration and of an arm width substantially equivalent to the width of said side frame members of said table for being received adjacent thereto in a generally flush configuration in said second position, said arms including a first support arm segment abuttingly received against the underside of said table surface in lateral supporting engagement therewith and pivotally connected to said side frame member of said table and to a second support arm segment which is pivotally connected to the support wall in rigid angular support of said work table, said first and second pivot arm segments being of unequal length and pivotally connected one to the other wherein said first support arm segment may be folded adjacent said second arm segment beneath said table and substantially within the notional plane defined by said side frame members of said table in a folded position wherein at least one of said side frame members includes a slot formed therein in a position adjacent said first support pivot arm segment when said first support arm is abuttingly received against the underside of the table surface, and a sliding latch member disposed within said slot for rectilinear movement relative to said support arm; and wherein one of said first and second segments of each said support arm is constructed with a slot formed therein adapted for matingly receiving said sliding latch member for locking engagement with said side frame member during a first orthogonal position of said table, and wherein said latching member may be slidably received into and out of said slot without affecting the structural support of said table by said support arms, and whereby said latching member may lock the supporting configuration of said table without being directly subjected to loading forces therefrom.

6. An improved method of supporting a wall mountable, folding table of the type wherein a substantially planar surface having side frame members on opposite sides thereof is hingedly connected to a vertical wall and supported therefrom by pivotal support arms of the type facilitating a first open position of the table in a generally orthogonal relationship to the vertical wall and a second folded position of the work table against said supporting wall, said support arms including first and second arm segments wherein the improvement comprises providing said support arms in a triangular, pivotal configuration;

abuttingly receiving said first support arm segment against the underside of said work table in lateral supporting engagement therewith;

pivotally connecting said first arm segment to said second arm segment and angularly supporting said work table with said second arm segment;

providing said first and second arm segments in unequal lengths and of a width substantially equivalent to the width of said side frame members for being substantially contained within the notional plane defined thereby during recessed positioning against said work table;

providing a latching member along at least one side frame member of said table, said latching member being adapted for engaging one of said support arms; and providing said adjacent support arm with a slot adapted for receiving said latch member of said side frame member for locking said folding table in said first position without direct structural loading thereof.

7. An improved method of supporting a foldable work surface outwardly from, and relative to, a vertical wall of the type wherein a generally planar, foldable work surface having side frame members on opposite sides thereof is hingedly connected to a vertical wall for generally orthogonal positioning relative thereto when underlyingly supported by at least one support arm, wherein the improvement comprises the steps of pivotally connecting said side frame members of said work surface to a vertical wall, providing a support arm having lengthwise disproportionate segmented members of a width substantially equivalent to the width of said side frame members for being received adjacent thereto in said folded configuration within the notional plane defined by said side frame members and said work surface, pivotally connecting said support arm members in a triangular pivot configuration between said work surface and said vertical wall, receiving a first support arm segmented member in a laterally abutting, rotated position against the underside of said table surface and creating a triangular support configuration between a second support arm segment, said support wall, and said work surface in its orthogonal position, and providing a slideable latch in one of said side wall members adapted fro engaging a slot formed in one of said support arm segmented members for coupling said support arm segments to said side frame members during the orthogonal positioning thereof for preventing the selective pivoting of said work surface from said orthogonal position when in the latched position.

8. The method as set forth in claim 7 wherein said step of providing a support arm having a lengthwise disproportionate segmented member includes providing said first segmented member in a length substantially less than said second segmented member for permitting foldable concealment within the underside of said work surface and the notional plane of said side frame members of said table surface.

9. The method as set forth in claim 8 wherein said method further includes the steps of collapsing said work surface from said orthogonal position, comprising the steps of first removing said latch from said pivot arm, pivoting said work surface upwardly relative to said support wall, rotating said first and second support arm segments downwardly relative to said work surface, pivoting said work surface downwardly relative to said support wall, and receiving said rotated support arm segments against said work surface within the notional plane defined by said side frame members of said work surface in a downwardly pivoted position for folded containment against said wall.

10. The method as set forth in claim 9 wherein said table surface further includes rounded end portions adapted for receiving a rounded contour of said support arm segment ends during said folded configuration.

* * * * *